US006820520B2

(12) United States Patent
Chen

(10) Patent No.: US 6,820,520 B2
(45) Date of Patent: Nov. 23, 2004

(54) RATCHET WRENCH HAVING A RIGID LOCKING STRUCTURE

(76) Inventor: Terence Chen, No. 325, Yungching Rd., Dungshan Shiang, Ilan (TW)

( * ) Notice: Subject to any disclaimer, the term of this patent is extended or adjusted under 35 U.S.C. 154(b) by 0 days.

(21) Appl. No.: 10/308,021

(22) Filed: Dec. 3, 2002

(65) Prior Publication Data

US 2004/0089107 A1 May 13, 2004

(30) Foreign Application Priority Data

Nov. 11, 2002 (TW) ..... 091218181 A

(51) Int. Cl.[7] ..... B25B 13/46

(52) U.S. Cl. ..... 81/60; 81/59.1; 81/63.1; 81/63.2

(58) Field of Search ..... 81/60, 59.1, 63.1, 81/63.2

(56) References Cited

U.S. PATENT DOCUMENTS 6,647,832 B2 * 11/2003 Hu ..... 81/63.2

* cited by examiner

*Primary Examiner*—Joseph J. Hail, III
*Assistant Examiner*—Alvin J. Grant
(74) *Attorney, Agent, or Firm*—Rosenberg, Klein & Lee

(57) ABSTRACT

A ratchet wrench having a rigid locking structure includes a wrench body, a ratchet wheel, a pawl member, and a restoring member. Thus, the support blocks of the pawl member are urged on the wall of the receiving chamber of the wrench body, thereby forming a double-support or multi-support structure between the pawl member and the wall of the receiving chamber of the wrench body, so that the locking teeth of the pawl member are engaged with the ratchet teeth of the ratchet wheel actually, closely, rigidly and stably, thereby increasing the efficient torque of the ratchet wrench, and thereby facilitating the user operating the ratchet wrench.

10 Claims, 7 Drawing Sheets

RATCHET WRENCH HAVING A RIGID LOCKING STRUCTURE

BACKGROUND OF THE INVENTION

1. Field of the Invention

The present invention relates to a ratchet wrench having a rigid locking structure, and more particularly to a ratchet wrench having a rigid locking structure, wherein the support blocks of the pawl member are urged on the wall of the receiving chamber of the wrench body, thereby forming a double-support or multi-support structure between the pawl member and the wall of the receiving chamber of the wrench body, so that the locking teeth of the pawl member are engaged with the ratchet teeth of the ratchet wheel actually, closely, rigidly and stably.

2. Description of the Related Art

A conventional ratchet wrench in accordance with the prior art shown in FIGS. 6 and 7 comprises a wrench body 90, a ratchet wheel 93, a pawl member 95, and a restoring member 96. The wrench body 90 has a driving head 91 having an inner wall formed with a receiving recess 92 and a receiving chamber 94. The ratchet wheel 93 is mounted in the receiving recess 92 of the driving head 91 of the wrench body 90 and has an outer wall formed with a plurality of ratchet teeth 930. The pawl member 95 is mounted in the receiving chamber 94 of the wrench body 90 and has a first side formed with a plurality of locking teeth 950 engaged with the ratchet teeth 930 of the ratchet wheel 93 and a second side formed with an arcuate resting face 97. The restoring member 96 is mounted in the receiving chamber 94 of the wrench body 90 and urged between the pawl member 95 and the wall of the receiving chamber 94 of the wrench body 90. Thus, a support force "F" is formed between the arcuate resting face 97 of the pawl member 95 and the wall of the receiving chamber 94 of the wrench body 90.

As shown in FIG. 6, the contact position of the arcuate resting face 97 of the pawl member 95 and the wall of the receiving chamber 94 of the wrench body 90 is located at the left end of the pawl member 95.

As shown in FIG. 7, the contact position of the arcuate resting face 97 of the pawl member 95 and the wall of the receiving chamber 94 of the wrench body 90 is located at the mediate portion of the pawl member 95.

However, the conventional ratchet wrench in accordance with the prior art has the following disadvantages.

1. The contact position of the arcuate resting face 97 of the pawl member 95 and the wall of the receiving chamber 94 of the wrench body 90 deflects and deviates as shown in FIGS. 6 and 7, so that the pawl member 95 is not engaged with the ratchet wheel 93 closely, rigidly and stably.

2. The contact position of the arcuate resting face 97 of the pawl member 95 and the wall of the receiving chamber 94 of the wrench body 90 is almost a point, thereby producing a stress concentration on the wall of the receiving chamber 94 of the wrench body 90, and thereby decreasing the lifetime of the ratchet wrench.

3. The contact position of the arcuate resting face 97 of the pawl member 95 and the wall of the receiving chamber 94 of the wrench body 90 is almost a point, thereby decreasing the torque of the ratchet wrench.

SUMMARY OF THE INVENTION

The present invention has arisen to mitigate and/or obviate the disadvantage of the conventional ratchet wrench.

The primary objective of the present invention is to provide a ratchet wrench having a rigid locking structure, wherein the support blocks of the pawl member are urged on the wall of the receiving chamber of the wrench body, thereby forming a double-support or multi-support structure between the pawl member and the wall of the receiving chamber of the wrench body, so that the locking teeth of the pawl member are engaged with the ratchet teeth of the ratchet wheel actually, closely, rigidly and stably.

Another objective of the present invention is to provide a ratchet wrench having a rigid locking structure, wherein the multiple support forces evenly support the pawl member, thereby preventing from producing a stress concentration on the wall of the receiving chamber of the wrench body, so that the pawl member is locked with the ratchet wheel actually and stably without slip or detachment.

A further objective of the present invention is to provide a ratchet wrench having a rigid locking structure, wherein the multiple support forces produce a larger force resistant area between the pawl member and the wall of the receiving chamber of the wrench body, thereby increasing the efficient torque of the ratchet wrench.

A further objective of the present invention is to provide a ratchet wrench having a rigid locking structure, wherein the multiple support forces evenly support the pawl member, thereby producing a larger force resistant area, and thereby preventing from producing a stress concentration on the wall of the receiving chamber of the wrench body, so as to increase the lifetime of the ratchet wrench.

A further objective of the present invention is to provide a ratchet wrench having a rigid locking structure, wherein the multiple support blocks evenly support the pawl member, so that the pawl member is moved on the wall of the receiving chamber of the wrench body smoothly and conveniently and is engaged with the ratchet wheel rapidly and rigidly, thereby facilitating the user operating the ratchet wrench.

In accordance with the present invention, there is provided a ratchet wrench having a rigid locking structure, comprising a wrench body, a ratchet wheel, a pawl member, and a restoring member, wherein:

- the wrench body has a driving head having an inner wall formed with a receiving recess and a receiving chamber located beside and communicated with the receiving recess;
- the ratchet wheel is mounted in the receiving recess of the driving head of the wrench body and has an outer wall formed with a plurality of ratchet teeth;
- the pawl member is mounted in the receiving chamber of the driving head of the wrench body and has a first side formed with a plurality of locking teeth engaged with the ratchet teeth of the ratchet wheel and a second side formed with a plurality of convex support blocks each rested on a wall of the receiving chamber of the driving head of the wrench body;
- the restoring member is mounted in the receiving chamber of the driving head of the wrench body and urged between the pawl member and the wall of the receiving chamber of the driving head of the wrench body.

Further benefits and advantages of the present invention will become apparent after a careful reading of the detailed description with appropriate reference to the accompanying drawings.

DETAILED DESCRIPTION OF THE INVENTION

Figure 1:
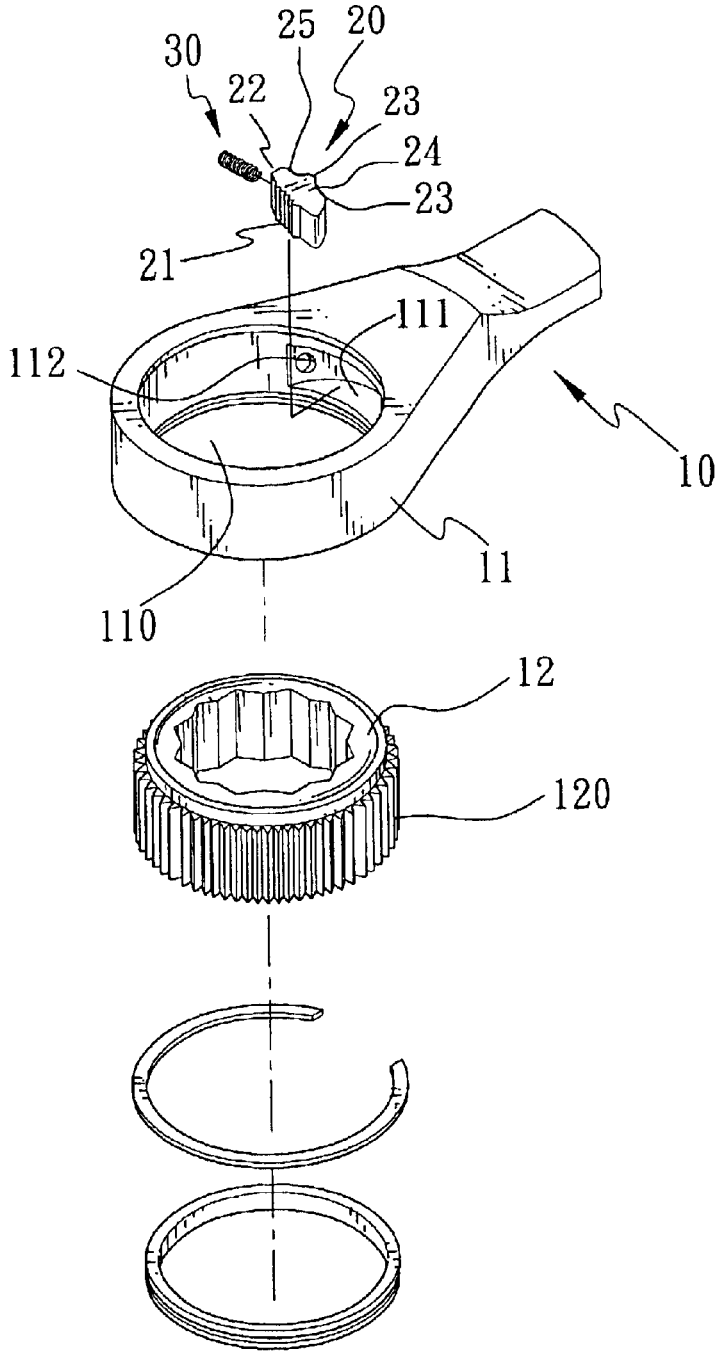
FIG. 1 is an exploded perspective view of a ratchet wrench having a rigid locking structure in accordance with a preferred embodiment of the present invention.
Figure 2:
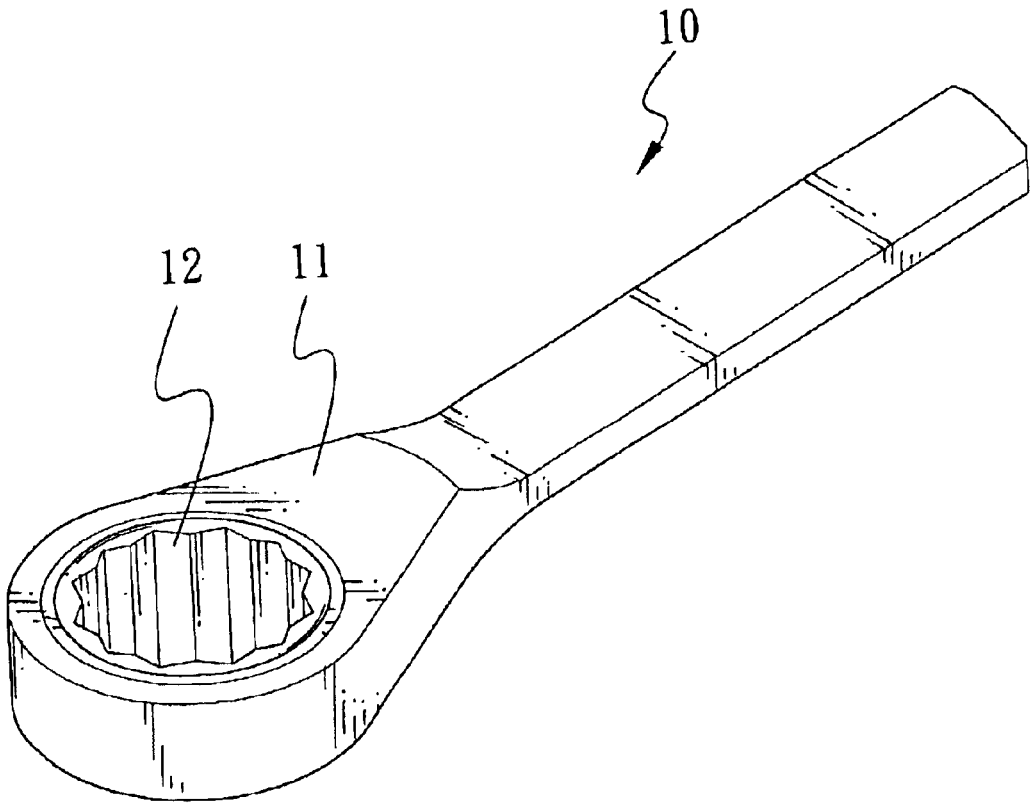
FIG. 2 is a perspective assembly view of the ratchet wrench having a rigid locking structure in accordance with the preferred embodiment of the present invention.

Referring to the drawings and initially to FIGS. 1–4, a ratchet wrench having a rigid locking structure in accordance with a preferred embodiment of the present invention comprises a wrench body 10, a ratchet wheel 12, a pawl member 20, and a restoring member 30.

The wrench body 10 has a driving head 11 having an inner wall formed with a receiving recess 110 and a receiving chamber 111 located beside and communicated with the receiving recess 110.

The ratchet wheel 12 is mounted in the receiving recess 110 of the driving head 11 of the wrench body 10 and has an outer wall formed with a plurality of ratchet teeth 120.

The pawl member 20 is mounted in the receiving chamber 111 of the driving head 11 of the wrench body 10 and has a first side formed with a plurality of locking teeth 21 engaged with the ratchet teeth 120 of the ratchet wheel 12 and a second side formed with a plurality of arcuate convex support blocks 23 each rested on a wall of the receiving chamber 111 of the driving head 11 of the wrench body 10. The second side of the pawl member 20 is formed with a plurality of arcuate concave spacing recesses 24 each located between any two adjacent support blocks 23. Preferably, the pawl member 20 has two support blocks 23 located on the two ends of the pawl member 20. The pawl member 20 has a first end mounted between the outer wall of the ratchet wheel 12 and the wall of the receiving chamber 111 of the driving head 11 of the wrench body 10 and a second end formed with a positioning portion 22. The second side of the pawl member 20 is formed with a jam prevention portion 25 located adjacent to the positioning portion 22.

The restoring member 30 is mounted in the receiving chamber 111 of the driving head 11 of the wrench body 10 and has a first end secured on the positioning portion 22 of the pawl member 20 and a second end secured in the wall of the receiving chamber 111 of the driving head 11 of the wrench body 10. Preferably, the positioning portion 22 of the pawl member 20 is formed with a cylindrical positioning stub 220 for securing the first end of the restoring member 30, and the wall of the receiving chamber 111 of the driving head 11 of the wrench body 10 is formed with a positioning cavity 112 for securing the second end of the restoring member 30. Preferably, the restoring member 30 is a compression spring.

Figure 3:
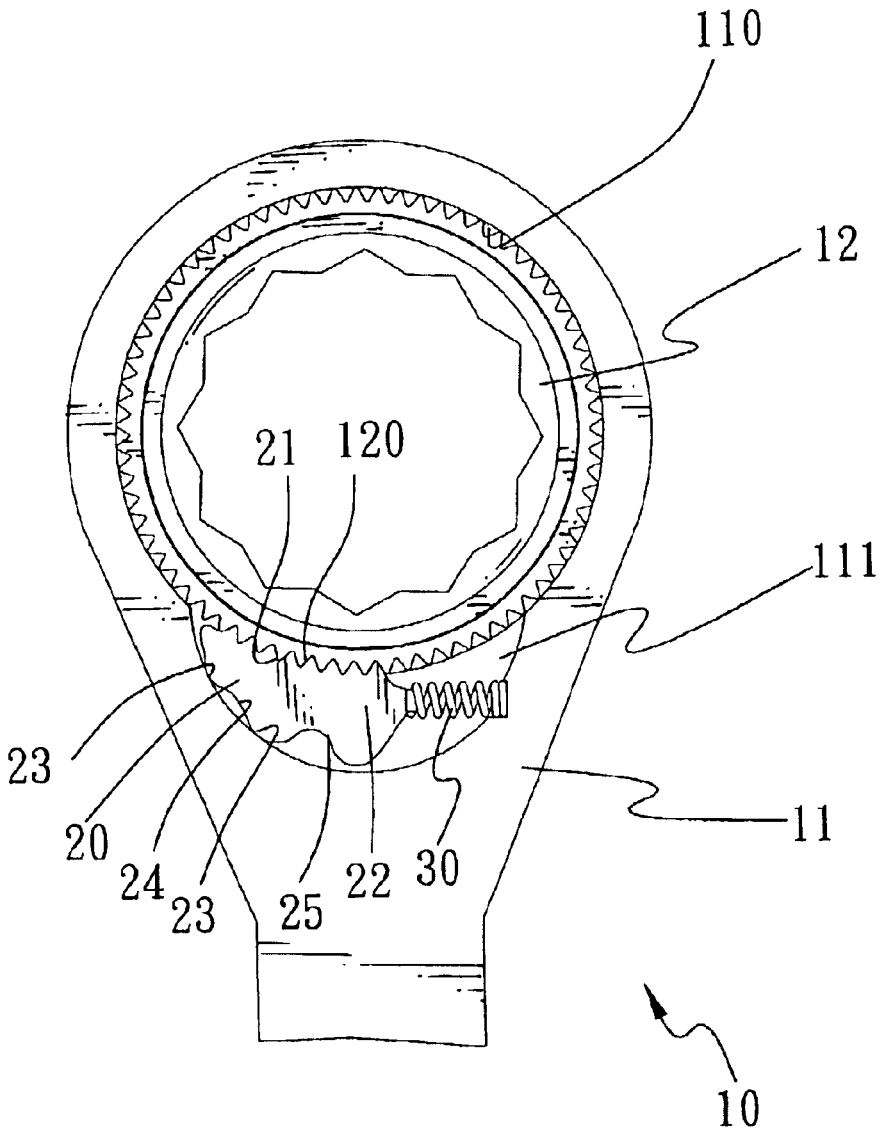
FIG. 3 is a cut-away top plan view of the ratchet wrench having a rigid locking structure as shown in FIG. 2.
Figure 4:
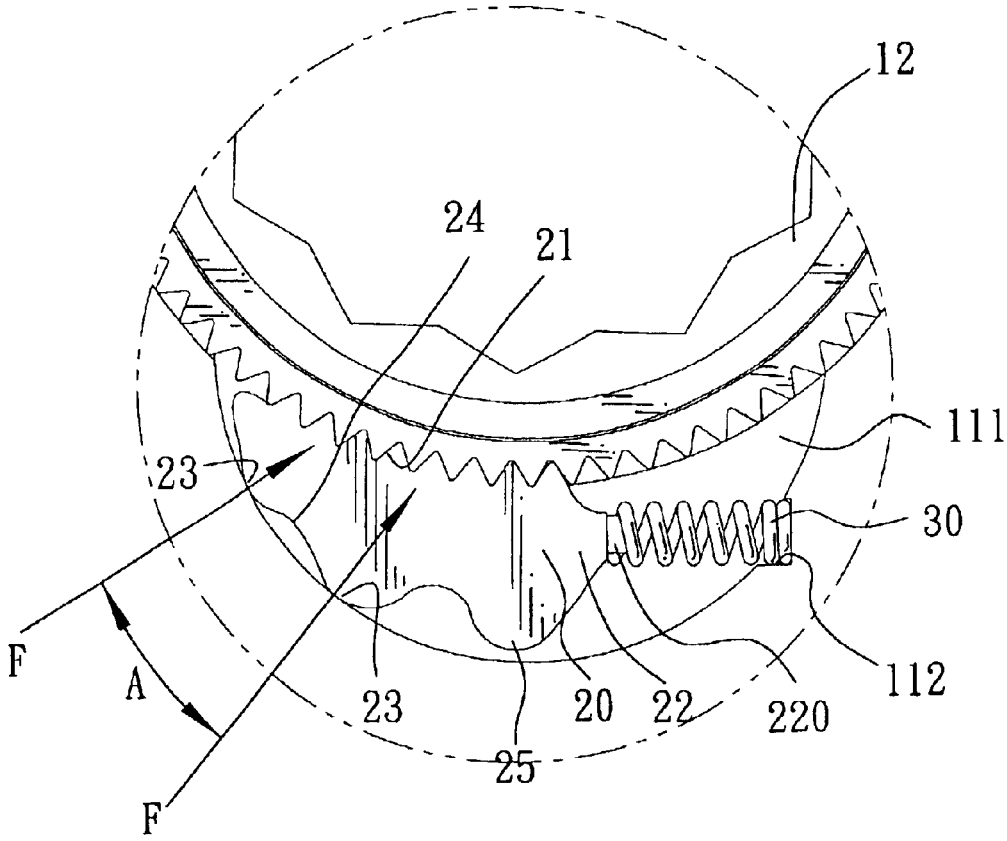
FIG. 4 is a partially cut-away enlarged view of the ratchet wrench having a rigid locking structure as shown in FIG. 3.

As shown in FIGS. 3 and 4, the pawl member 20 is urged by the restoring member 30, and the two support blocks 23 of the pawl member 20 are urged on the wall of the receiving chamber 111 of the wrench body 10, so that the locking teeth 21 of the pawl member 20 are engaged with the ratchet teeth 120 of the ratchet wheel 12, so that the ratchet wheel 12 is driven to rotate a workpiece (not shown) by rotation of the driving head 11 of the wrench body 10.

In such a manner, the two support blocks 23 of the pawl member 20 are urged on the wall of the receiving chamber 111 of the wrench body 10, thereby forming two support forces "F" between the two support blocks 23 of the pawl member 20 and the wall of the receiving chamber 111 of the wrench body 10, so that the locking teeth 21 of the pawl member 20 are engaged with the ratchet teeth 120 of the ratchet wheel 12 actually, closely, rigidly and stably. In addition, the two support forces "F" evenly support the two ends of the pawl member 20, so that the pawl member 20 is locked with the ratchet wheel 12 actually and stably.

Figure 5:
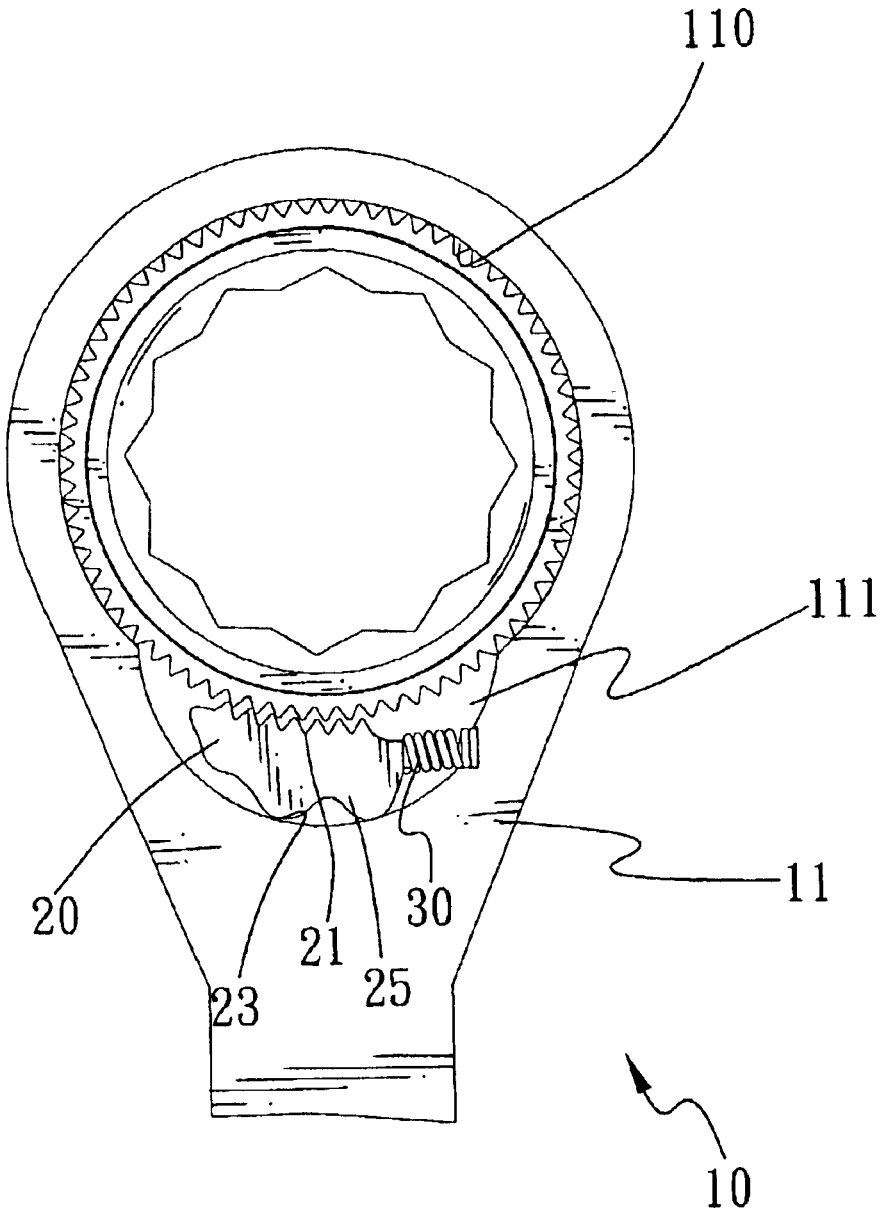
FIG. 5 is a schematic operational view of the ratchet wrench having a rigid locking structure as shown in FIG. 3.
Figure 6:
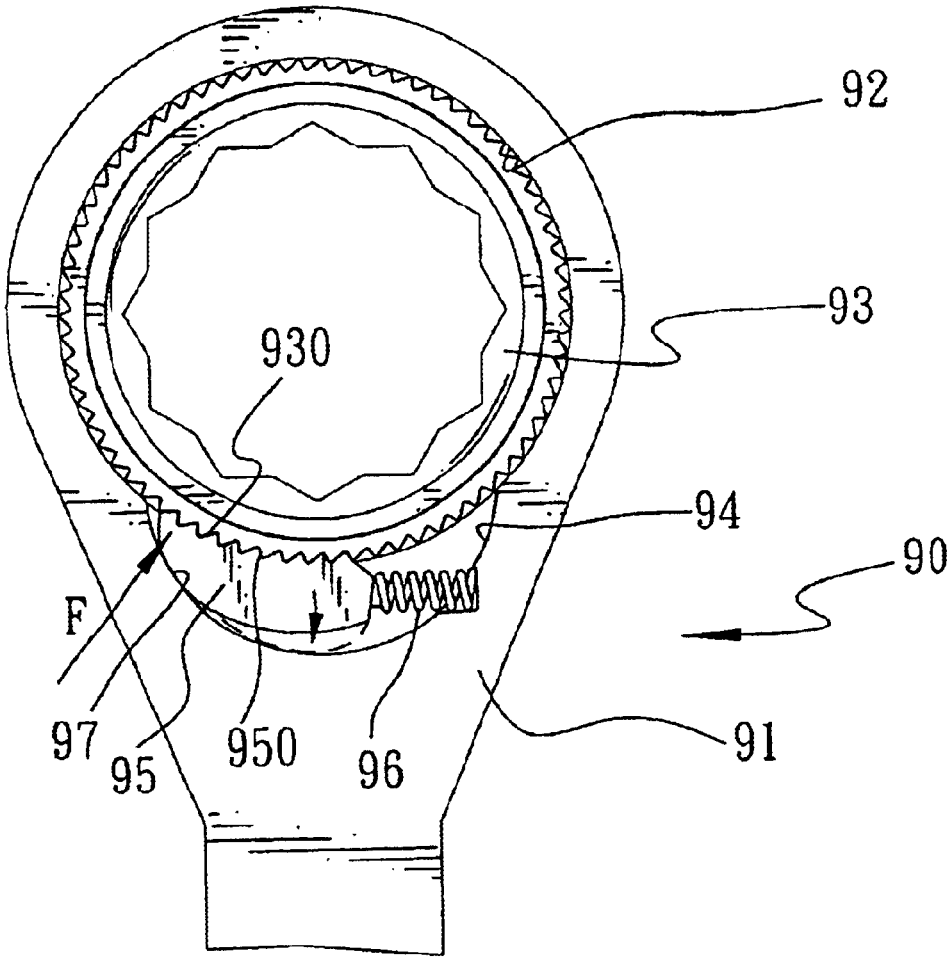
FIG. 6 PRIOR ART
FIG. 6 is a cut-away top plan view of a conventional ratchet wrench in accordance with the prior art.
Figure 7:
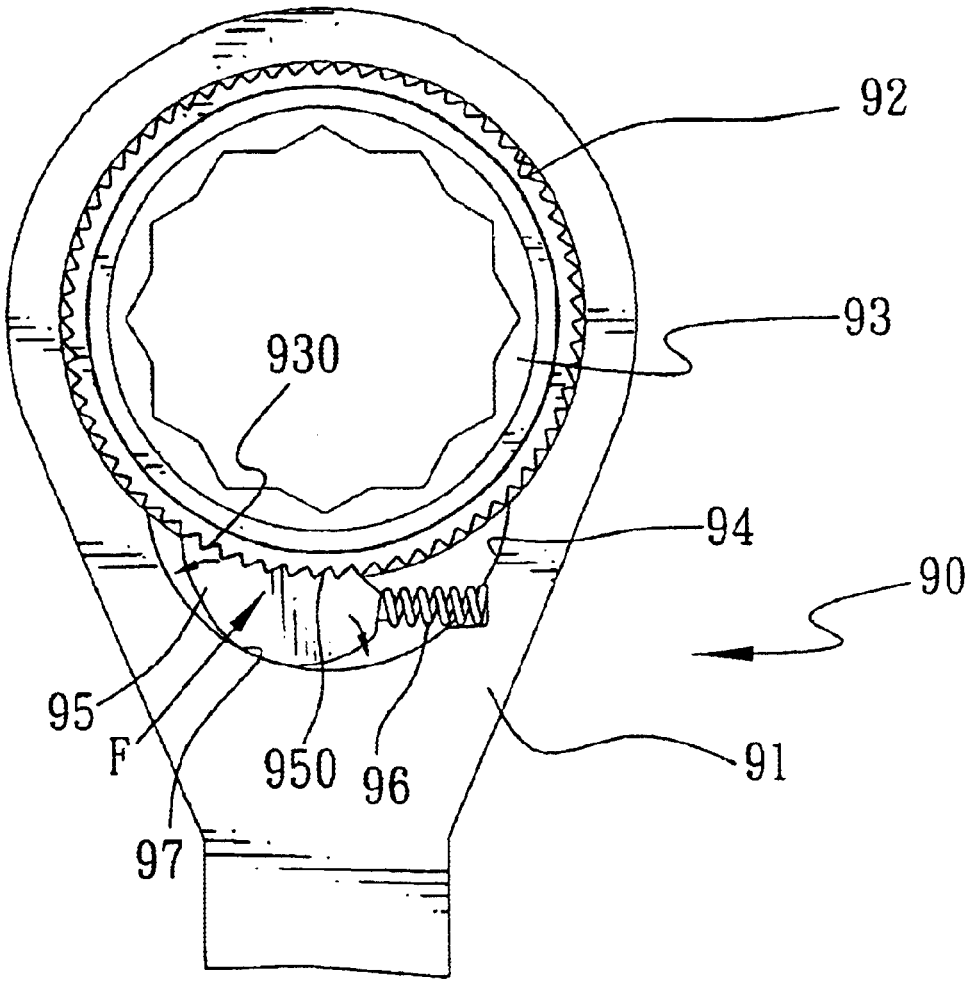
FIG. 7 PRIOR ART
FIG. 7 is a schematic operational view of the conventional ratchet wrench having a rigid locking structure as shown in FIG. 6.

As shown in FIG. 5, the second side of the pawl member 20 is formed with a jam prevention portion 25. Thus, when the pawl member 20 is moved backward by rotation of the driving head 11 of the wrench body 10, the jam prevention portion 25 of the pawl member 20 is rested on the wall of the receiving chamber 111 of the wrench body 10, so that the locking teeth 21 of the pawl member 20 are disengaged from the ratchet teeth 120 of the ratchet wheel 12 actually, thereby preventing the locking teeth 21 of the pawl member 20 from jamming with the ratchet teeth 120 of the ratchet wheel 12.

Accordingly, the ratchet wrench having a rigid locking structure in accordance with the present invention has the following advantages.

1. The support blocks 23 of the pawl member 20 are urged on the wall of the receiving chamber 111 of the wrench body 10, thereby forming a double-support or multi-support structure between the pawl member 20 and the wall of the receiving chamber 111 of the wrench body 10, so that the locking teeth 21 of the pawl member 20 are engaged with the ratchet teeth 120 of the ratchet wheel 12 actually, closely, rigidly and stably.

2. The multiple support forces "F" evenly support the pawl member 20, thereby preventing from producing a stress concentration on the wall of the receiving chamber 111 of the wrench body 10, so that the pawl member 20 is locked with the ratchet wheel 12 actually and stably without slip or detachment.

3. The multiple support forces "F" produce a larger force resistant area "A" between the pawl member 20 and the wall of the receiving chamber 111 of the wrench body 10, thereby increasing the efficient torque of the ratchet wrench.

4. The multiple support forces "F" evenly support the pawl member 20, thereby producing a larger force resistant area "A", and thereby preventing from producing a stress concentration on the wall of the receiving chamber 111 of the wrench body 10, so as to increase the lifetime of the ratchet wrench.

5. The multiple support blocks 23 evenly support the pawl member 20, so that the pawl member 20 is moved on the wall of the receiving chamber 111 of the wrench body 10 smoothly and conveniently and is engaged with the ratchet wheel 12 rapidly and rigidly, thereby facilitating the user operating the ratchet wrench.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A ratchet wrench having a rigid locking structure, comprising a wrench body, a ratchet wheel, a pawl member, and a restoring member, wherein:

the wrench body has a driving head having an inner wall formed with a receiving recess and a receiving chamber located beside and communicated with the receiving recess;

the ratchet wheel is mounted in the receiving recess of the driving head of the wrench body and has an outer wall formed with a plurality of ratchet teeth;

the pawl member is mounted in the receiving chamber of the driving head of the wrench body and has a first side formed with a plurality of locking teeth engaged with the ratchet teeth of the ratchet wheel and a second side formed with a plurality of convex support blocks each rested on a wall of the receiving chamber of the driving head of the wrench body;

the restoring member is mounted in the receiving chamber of the driving head of the wrench body and urged between the pawl member and the wall of the receiving chamber of the driving head of the wrench body.

2. The ratchet wrench having a rigid locking structure in accordance with claim 1, wherein the support blocks of the pawl member has an arcuate shape.

3. The ratchet wrench having a rigid locking structure in accordance with claim 1, wherein the second side of the pawl member is formed with a plurality of arcuate concave spacing recesses each located between any two adjacent support blocks.

4. The ratchet wrench having a rigid locking structure in accordance with claim 1, wherein the pawl member has two support blocks located on the two ends of the pawl member.

5. The ratchet wrench having a rigid locking structure in accordance with claim 1, wherein the pawl member has a first end mounted between the outer wall of the ratchet wheel and the wall of the receiving chamber of the driving head of the wrench body and a second end formed with a positioning portion.

6. The ratchet wrench having a rigid locking structure in accordance with claim 5, wherein the restoring member has a first end secured on the positioning portion of the pawl member and a second end secured in the wall of the receiving chamber of the driving head of the wrench body.

7. The ratchet wrench having a rigid locking structure in accordance with claim 6, wherein the positioning portion of the pawl member is formed with a cylindrical positioning stub for securing the first end of the restoring member.

8. The ratchet wrench having a rigid locking structure in accordance with claim 6, wherein the wall of the receiving chamber of the driving head of the wrench body is formed with a positioning cavity for securing the second end of the restoring member.

9. The ratchet wrench having a rigid locking structure in accordance with claim 1, wherein the second side of the pawl member is formed with a jam prevention portion.

10. The ratchet wrench having a rigid locking structure in accordance with claim 1, wherein the restoring member is a compression spring.

* * * * *